US005886713A

United States Patent [19]

Okada et al.

[11] Patent Number: 5,886,713

[45] **Date of Patent: *Mar. 23, 1999**

[54] PRINTHEAD AND PRINTING APPARATUS USING THE SAME

[75] Inventors: Masaaki Okada, Sanjo; Yoshiyuki Imanaka, Kawasaki; Yuji Kamiyama, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 615,822

[22] Filed: Mar. 14, 1996

[30] Foreign Application Priority Data

Mar. 17, 1995 [JP] Japan ..... 7-058465

[51] Int. Cl.[6] ..... B41J 29/38

[52] U.S. Cl. ..... 347/14

[58] Field of Search ..... 347/6, 7, 10, 14, 347/19, 26, 37, 54, 56, 57

[56] References Cited

U.S. PATENT DOCUMENTS

| | | | |
|---|---|---|---|
| 4,313,124 | 1/1982 | Hara . | |
| 4,328,504 | 5/1982 | Weber et al. | 347/14 |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,587,535 | 5/1986 | Watanabe | 347/23 |
| 4,723,129 | 2/1988 | Endo et al. . | |
| 4,740,796 | 4/1988 | Endo et al. . | |
| 4,853,718 | 8/1989 | ElHatem et al. | 347/7 |
| 5,072,235 | 12/1991 | Slowik et al. | 347/19 |
| 5,627,571 | 5/1997 | Anderson et al. | 347/19 |

FOREIGN PATENT DOCUMENTS

| | | |
|---|---|---|
| 2843064 | 4/1979 | Germany . |
| 54-051837 | 4/1979 | Japan . |
| 59-123670 | 7/1984 | Japan . |
| 59-138461 | 8/1984 | Japan . |
| 7-52387 | 2/1995 | Japan . |

*Primary Examiner*—Matthew Nguyen
*Attorney, Agent, or Firm*—Fitzpatrick, Cella, Harper & Scinto

[57] ABSTRACT

A printhead capable of informing a printer of existence or absence of ink so as to prevent an ink discharge failure without increasing manufacturing cost and causing increase in size, and a printer using the printhead capable of performing printing operation at high speed without any heavy processing load and causing increase in size are disclosed. This printhead comprises an ink sensor or a thermosensor including a circuit for processing an output signal from the sensor, and outputs a processed result of the output signal from the sensor to a control circuit of the printing apparatus. The control circuit of the printing apparatus controls so as to terminate a printing operation in accordance with a signal level of the inputted signal, and to start an ink suction recovery operation.

26 Claims, 12 Drawing Sheets

PRINTHEAD AND PRINTING APPARATUS USING THE SAME

BACKGROUND OF THE INVENTION

This invention relates to a printhead and a printing apparatus using the same and, more particularly, to a printhead which performs printing by using the ink-jet method and a printing apparatus using the printhead.

Conventional printing methods adopting the ink-jet method have advantages that it is possible to minimize noises made during a printing operation to the ignorable level as well as to perform the printing operation at high speed, furthermore, to fix ink to print on so-called ordinary paper without performing any special processing, thereby generating interest.

Among the conventional printing methods, the ink-jet printing methods, disclosed in the Japanese Patent Laid-Open No. 54-51837 and the German Patent Publication (DOLS) No. 2843064, have unique characteristics different from other printing methods adopting common ink-jet printing methods in the point that thermal energy is applied to liquid to obtain motive power for discharging ink.

More specifically, according to the printing method disclosed in the aforesaid patent publications, printing is performed in such a manner that liquid which is applied with thermal energy changes its state accompanied by sudden volume expansion, and ink droplets are discharged from orifices at the end of a printhead of a printer, caused by action of the state change, then the discharged ink droplets stick to recording medium, such as printing paper.

FIGS. 10A to 10G show a principle of discharging an ink droplet from a printhead in the ink-jet printing method.

In the stationary state, as shown in FIG. 10A, ink 31 filling a nozzle 32 is in a state where the surface tension of the ink at an orifice is in equilibrium to external pressure. In order to discharge the ink under this condition, first, an electric current is supplied to an electrothermal transducer 30 which is in the nozzle for causing a rapid rise in temperature to the ink in the nozzle over a film boiling temperature. Accordingly, as shown in FIG. 10B, the ink 31 neighboring to the electrothermal transducer 30 is heated up and tiny bubbles are created, then the heated portion of the ink vaporizes, thus reaching the film in boiling state. As a result, a bubble rapidly grows as shown in FIG. 10C.

When the bubble grows to the maximum as shown in FIG. 10D, an ink droplet is forced out from an orifice of the nozzle. Then, after stopping the supply of electric current to the electrothermal transducer 30, the grown bubble cools down in the nozzle and shrinks as shown in FIG. 10E. As described above, an ink droplet is discharged from the orifice by growth and shrinkage of the bubble. The size of the ink droplet 33 can be controlled by electric current supply time and sequence to the electrothermal transducer 30.

Further, as shown in FIG. 10F, the ink adjacent to the surface of the electrothermal transducer 30 is rapidly cooled down, and the bubble disappears or shrinks to an ignorable volume. As the bubble shrinks, ink is provided from a common ink chamber to the nozzle caused by the capillary phenomenon, as shown in FIG. 10G, and ready for the next current supply.

Therefore, by reciprocally moving a carriage, loaded with such a printhead (the moving direction of the carriage is referred to as "main scanning direction", hereinafter) and discharging an ink droplet from the nozzle caused by supplying an electric current to an electrothermal transducer in response to image signals generated in synchronization with the carriage movement, an ink image is printed on recording medium, such as printing paper.

In the principle as described above, an ink droplet is formed in accordance with an image signal, thereby an image is printed on recording medium.

Especially, according to the ink-jet printing method disclosed in the DOLS No. 2843064, it can be very effectively applied to the so-called drop-on-demand printing method and a full-line printhead including a plurality of high-density aligned orifices can be easily manufactured, thereby a high-resolution and high-quality image can be obtained at high speed.

The printhead of a printer used in the aforesaid printing method comprises an orifice for discharging an ink droplet, a heat conductor, commonly connected to the orifice, which applies thermal energy causing the discharge of the droplet to liquid, and a printhead board including an ink discharging unit having a flow channel and an electrothermal transducer as means for generating thermal energy.

The above printhead board is provided with a plurality of heaters aligned, drivers corresponding to the plurality of respective heaters for driving corresponding heaters on the basis of the input image data, a shift register for temporarily storing the same number of bits of image data as the number of the heaters so as to output the sequentially inputted image data to each driver as parallel data, and a latch circuit for temporarily storing the data outputted from the shift register, all of which are arranged on a single substrate. The printhead board integrated on the single substrate, as described above, is configured in such a manner that a heating element is made on an IC constructed with bipolar transistors (Bi-CMOS), C-MOS, and the like, and a plurality of such ICs are integrated on a silicon substrate.

FIG. 11 shows a logical circuit of the conventional printhead board comprising 64 printing elements. In FIG. 11, reference numeral 101 denotes the 64 aligned heaters; 102, power transistors; 103, a latch circuit; and 104, a shift register. Further, reference numeral 105 denotes a clock signal input terminal for inputting a clock signal used for activating the shift register 104; 106, an image data input terminal; 107, a strobe input terminal for inputting a heat pulse width control signal used for controlling "ON" period of a power transistor 102 from outside; 108, a logic circuit power supply terminal; 109, a GND terminal of the logic circuit 108; 110, a heater driver power supply (VH) terminal; 111, a GND terminal of the power transistors 102; 117, a latch signal input terminal; and 118, an AND circuit.

In the printhead adopting the ink-jet method, by reducing the number of elements to discharge ink concurrently, the quality of a printed image is not affected by ink supply from an ink tank, thereby high quality image printing can be realized. Therefore, the plurality of printing elements provided inside of the printhead are divided into a plurality of blocks so as to operate each block at different timing and be controlled so that neighboring printing elements do not discharge ink concurrently.

For instance, in the printhead shown in FIG. 11, the 64 printing elements are divided into 8 blocks each of which includes 8 printing elements, and printing operation is performed by each block. Further, among the printing elements in the same block, odd-numbered printing elements and even-numbered printing elements operate at different timing so that the neighboring printing elements do not discharge ink concurrently. Therefore, input terminals 114 to 116 for inputting block selection signals, an input terminal 112 for inputting an odd-numbered element selection signal; an input terminal 113 for inputting an even-numbered element selection signal, and a decoder 119 are provided. Here, the odd-numbered element selection signal is a control signal for selecting the heaters numbered by odd-numbers among numbers put on the left upper position of each heater, 1st, 2nd, 3rd, . . . , 64th, in FIG. 11, to discharge ink, and the even-numbered element selection signal is a control signal for selecting the odd-numbered heaters to discharge ink. Further, the decoder 119 selects one of the 8 blocks in accordance with the block selection signals inputted from the terminals 114 to 116.

In the printer including the printhead having a configuration as described above, image data is inputted from the image data input terminal 106 to the shift register 104 in serial, and, when 64 bits of image data are inputted, the input image data is latched by the latch circuit 103. Then, either the odd-numbered or even-numbered power transistors 102, corresponding to AND circuit 118 which are inputted with the "ON" latched data and the "ON" heat pulse width control signal inputted from the input terminal 107, which are in a block selected by the decoder 119 are turned ON, the heaters 101 are driven, and ink in the flow channels corresponding to the driven heaters 101 is heated up, then the ink is discharged from orifices thereby image is printed.

FIG. 12 is a cross-sectional view of the printhead board shown in FIG. 11.

As shown in FIG. 12, a dopant, such as As (arsenic), is doped to a silicon substrate 201 of a P electronic conductor by ion implantation and diffusion method, thereby forming n type epitaxial layer 203. Further, the n type epitaxial layer 203 is doped with impurity, such as B (boron), thereby forming a p type well region 204. Thereafter, doping is repeated by using methods, such as photolithography, oxidation diffusion, and ion implantation, and p-MOS 250 is formed in the n type epitaxial region and n-MOS 251 is formed in the p type well region. Each of the p-MOS 250 and the n-MOS 251 consists of gate wiring 215 made of polysilicon which is deposited in chemical vapor deposition (CVD) method separated by a gate insulation film 208 of some hundred Å (angstrom), an n or p type doped source region 205, and a drain region 206.

The latch circuit 103 and a logic part of the shift register (S/R) 104 are constructed with the aforesaid MOS transistors.

Further, npn type power transistor 252, constructed with a collector region 211, a base region 212, an emitter region 213, and the like, acted as the driver 102 for the heater 101 is formed in the n epitaxial layer by doping, diffusion process, or the like.

Further, an oxide film separating region 253, formed by field oxidization, separates each element. This field oxide film serves as a heat storage layer 214 in the first layer under a heating element 255. This field oxide film serves as a heat storage layer 214 in the first layer under a heating element 255.

After each element is formed, phosho-silicate glass (PSG) or BPSG is deposited according to the CVD method to form an interlayer insulation film 216, and smoothed by using heat process. Thereafter, wiring is arranged by using an aluminum electrode 217 in the first layer through a contact hole. Then, an interlayer insulation film 218 of silicon monoxide (SiO), for example, is deposited by a plasma CVD method, further, a heater layer 219 is connected to the aluminum electrode 217 through a contact hole.

The passivation film 221 is made of monosilicon mononitride (SiN) film formed by the plasma CVD method. In the upper most layer, anti-cavitation film 222 of tantalum (Ta), or the like, is deposited with an opening part, i.e., a pad part 254. Further, reference numeral 220 denotes another aluminum electrode.

In the above explanation, bipolar transistor is used as the power transistor, however, a MOS transistor can be used also.

As described above, the printhead drivers adopting the ink-jet method aimed for high quality printing are divided into a plurality of blocks as shown in FIG. 11, thereby it is unnecessary to supply ink in a timewise concentrated manner from the ink tank to the printhead, and the ink is supplied in an unstrained manner. Further, by preventing droplets from being discharged from neighboring nozzles simultaneously, stable ink supply from the ink tank to ink nozzles becomes possible. Furthermore, in discharging ink by driving heating elements, since pressure is applied not only in the discharging direction but also in the direction to a common ink chamber 305 (shown in FIG. 13), nozzles neighboring to the discharging nozzles are efficiently refilled with ink, thereby ink supply can be stabilized.

FIG. 13 is a perspective view illustrating a structure of a printhead adopting the conventional ink-jet method. In FIG. 13, reference numeral 301 is a flow channel wall for separating nozzles; 302, a flow channel; 303, a top board; 304, an orifice; 305, a common ink chamber for supplying ink to a plurality of nozzles; and 306, an ink supply tube for supplying ink from an ink tank (not shown) to the common ink chamber 305.

With the aforesaid configuration, actual printing is performed by heating the ink inside of a nozzle by supplying energy to a heating element, making an ink droplet discharged from the nozzle, then fixing the ink droplet on recording medium.

When bubbles are formed and grow in the ink supply tube 306 for supplying ink from the ink tank to the nozzles and in the common ink chamber 305, and move and reach the flow channel 302 as it is refilled with ink, ink may not be discharged even though there is ink in the ink tank. This phenomena is called "ink discharge failure", and some dots are not printed in the actual printing process, thereby resulting in noticeable degradation in printing quality.

Possible reasons why these bubbles are produced would be: (1) relating to a principle of discharging an ink droplet, when ink is suddenly cooled down, a shrunk bubble does not disappear completely and remains; (2) gas dissolved in the ink appears in the common ink chamber 305 as bubbles; and (3) external air enters to the flow channel from the orifice.

Print failure caused by the ink discharge failure results in another printing operation, wasting time for printing and also wastes recording medium. Therefore, the ink discharge failure is unwelcomed in a printing apparatus adopting the ink-jet method.

Accordingly, in the conventional printing apparatus adopting the ink-jet method, the following two countermeasures are taken in order to prevent the above printing failure.

(1) Perform an automatic recovery operation to periodically remove such ink from nozzles before starting a printing operation.

(2) Measure the internal temperature of the printhead by using a thermosensor provided inside of the printhead, detect abnormal rise in temperature inside of the printhead when the ink discharge failure occurs, and perform ink suction recovery in accordance with the detected result. More specifically, the temperature inside of the printhead is measured by the thermosensor before and after an ink discharge operation, so-called preliminary discharge, for discharging viscous ink inside of the nozzles in advance to a printing operation when the printhead has been left unused for a while is effected. Then, whether the ink discharge failure would occur or the ink would be normally discharged is determined on the basis of the difference between the measured temperatures. If the ink supply is stopped in the middle of a printing operation, the internal temperature of the printhead increases by more than 10° C. comparing to the temperature when the ink is normally discharged. Thus, in a case where such the abnormal rise in temperature is detected, the ink suction recovery operation is automatically performed. Further, temperature is measured periodically during performing a printing operation so as to check an abnormal temperature rise in the printhead.

In the aforesaid embodiments, however, there are following problems.

(1) Since ink is periodically sucked from nozzles, ink is sucked even when the ink discharge failure has not occurred. Thus, a considerable amount of ink not actually used for printing is wasted, thereby the running cost per printing paper sheet increases. Further, the sucked ink is stored in a disposal ink tank in the printing apparatus, and this disposal ink tank prevents down-sizing. Especially, in a case where the sucked ink is stored in the disposal ink tank as wasted ink, it is necessary to change or empty the disposal ink tank frequently.

(2) Function for measuring an internal temperature of the printhead and an arithmetic operating function are necessary in the printing apparatus, and the measuring function causes an increase in manufacturing cost. Further, frequent temperature measurement and calculation for obtaining a difference in temperature result in putting a considerable load on the CPU of a control circuit, which decreases printing speed. This is a fatal problem for the printing apparatus. In addition, the ink discharge failure is not detected perfectly.

SUMMARY OF THE INVENTION

The present invention has been made in consideration of the above situation, and has as its object to provide a printhead lowering manufacturing cost as well as realizing down-sizing of a printing apparatus and capable of detecting ink discharge failure without affecting printing speed.

According to one aspect of the present invention, the foregoing object is attained by providing a printhead for printing on recording medium by applying an electric current pulse to an electrothermal transducer so as to generate heat, and discharging ink droplet from a nozzle by utilizing the generated heat, the printhead comprising: a driving circuit for driving the electrothermal transducer; a sensor circuit for determining existence or absence of ink to be discharged in the nozzle; a processing circuit for processing an output signal from the sensor circuit; and an output terminal for outputting a result obtained by the processing circuit to outside as a determination result, wherein the sensor circuit, the processing circuit, and the output terminal are packaged in a single substrate on which the driving circuit is integrated.

It is another object of the present invention to provide a printing apparatus using the above printhead.

According to another aspect of the present invention, the foregoing object is attained by providing a printing apparatus using the above printhead, comprising: input means for inputting the determination result outputted from the output terminal; recovery means for performing a recovery operation by discharging ink from the printhead; and recovery operation control means for terminating a printing operation in accordance with the determination result and controlling the recovery means so as to perform the recovery operation.

In accordance with the printhead provided in the present invention as described above, a sensor circuit for determining existence or absence of ink to be discharged in the nozzle, a processing circuit for processing an output signal from the sensor circuit, and an output terminal for outputting a result obtained by the processing circuit to outside as a determination result are packaged in a single substrate on which the driving circuit for driving a electrothermal transducer is integrated, and the determination result, that is a processed result which indicates existence or absence of ink, is outputted to outside.

In accordance with the printing apparatus employing the printhead as described above, the output determination result is inputted, and the printing operation is stopped and a recovery operation is performed in accordance with the determination result.

The invention is particularly advantageous since it is possible to construct a circuit for detecting existence or absence of ink in a nozzle without up-sizing the printhead.

Further, the cost of manufacturing the printhead is reduced since the sensor circuit, the processing circuit and the output terminal are packaged on the same substrate that the driving circuit is integrated.

Furthermore, since a signal, outputted from the sensor circuit, indicating the existence or absence of ink is processed and outputted to the outside, thus reducing load of processing the signal in the printing apparatus which receives the signal and is responsible for print control. Accordingly, it is possible to control printing so as to prevent the ink discharge failure without affecting speed of the printing operation of the printing apparatus. Therefore, the printing apparatus does not require a processor of high processing ability for detecting existence or absence of ink, thereby removing a problem which causes increase in cost of manufacturing the printing apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

A preferred embodiment of the present invention will be described in detail in accordance with the accompanying drawings.

<Brief Description of the Apparatus Main Unit>

Figure 1:
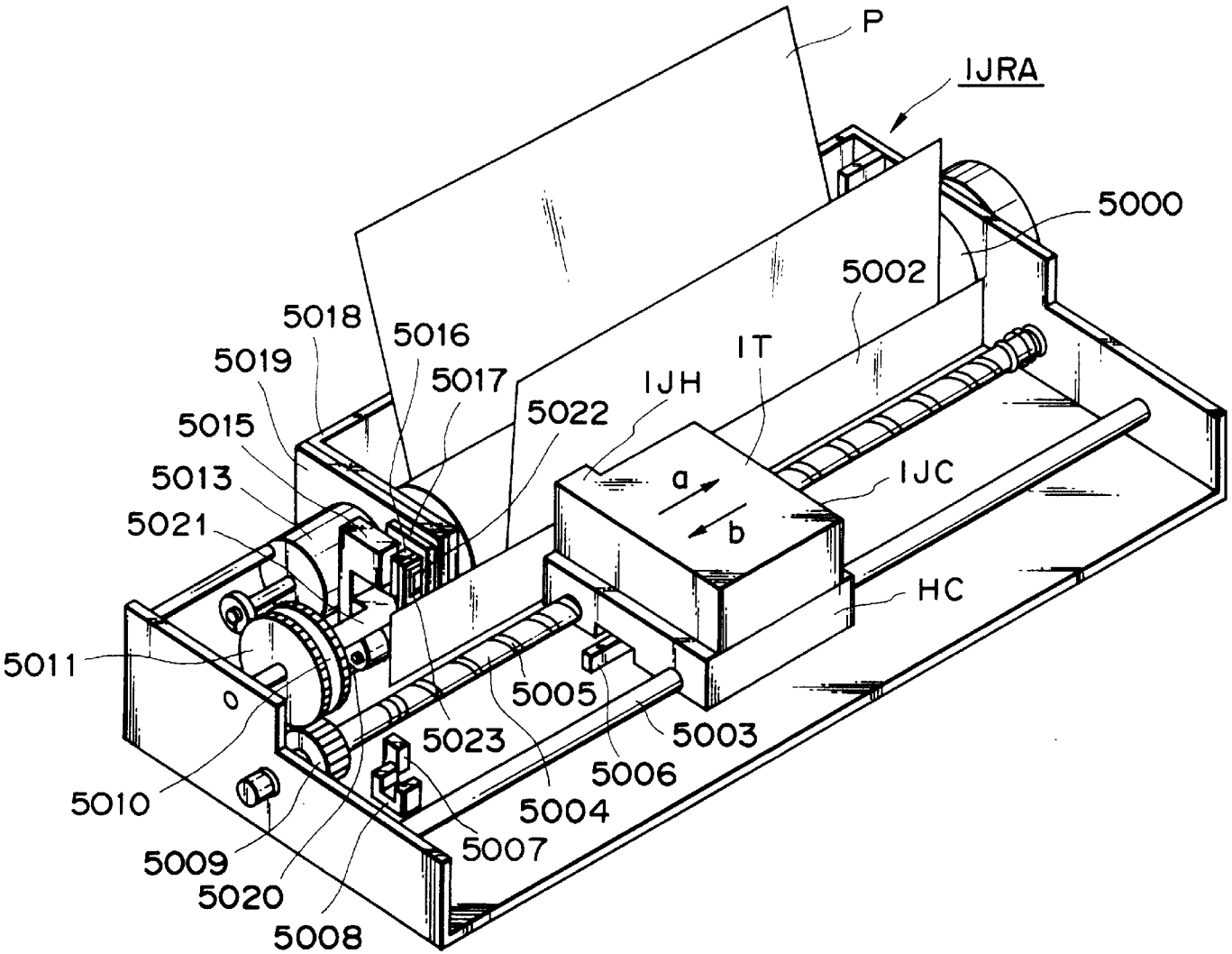
FIG. 1 is an external perspective view illustrating a configuration of a typical embodiment, an ink-jet printer IJRA, of the present invention.

FIG. 1 is an external perspective view showing the outer appearance of an ink-jet printer (simply referred to as "printer", hereinafter) IJRA as a typical embodiment of the present invention. Referring to FIG. 1, a carriage HC engages with a spiral groove 5005 of a lead screw 5004 which rotates via driving force transmission gears 5009 to 5011 upon forward/reverse rotation of a driving motor 5013. The carriage HC has a pin (not shown), and is reciprocally scanned in the directions of arrows a and b in FIG. 1. An integrated ink-jet cartridge IJC which incorporates a printhead IJH and an ink tank IT is mounted on the carriage HC. Reference numeral 5002 denotes a sheet pressing plate, which presses a printing paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022 which caps the front surface of the printhead IJH; and 5015, a suction device for sucking ink residue in the interior of the cap member. The suction device 5015 performs suction recovery of the printhead via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timing.

Note, as a recovery operation of the printhead IJH besides the aforesaid suction recovery, an operation in which pressure is applied to an ink flow channel inside of the printhead IJH and ink is forced to be discharged from the orifice of the printhead IJH may be performed, for example.

<Explanation of an Arrangement of a Control Circuit>

Next, an arrangement of a control circuit for controlling a printing operation in the aforesaid printer will be described.

Figure 2:
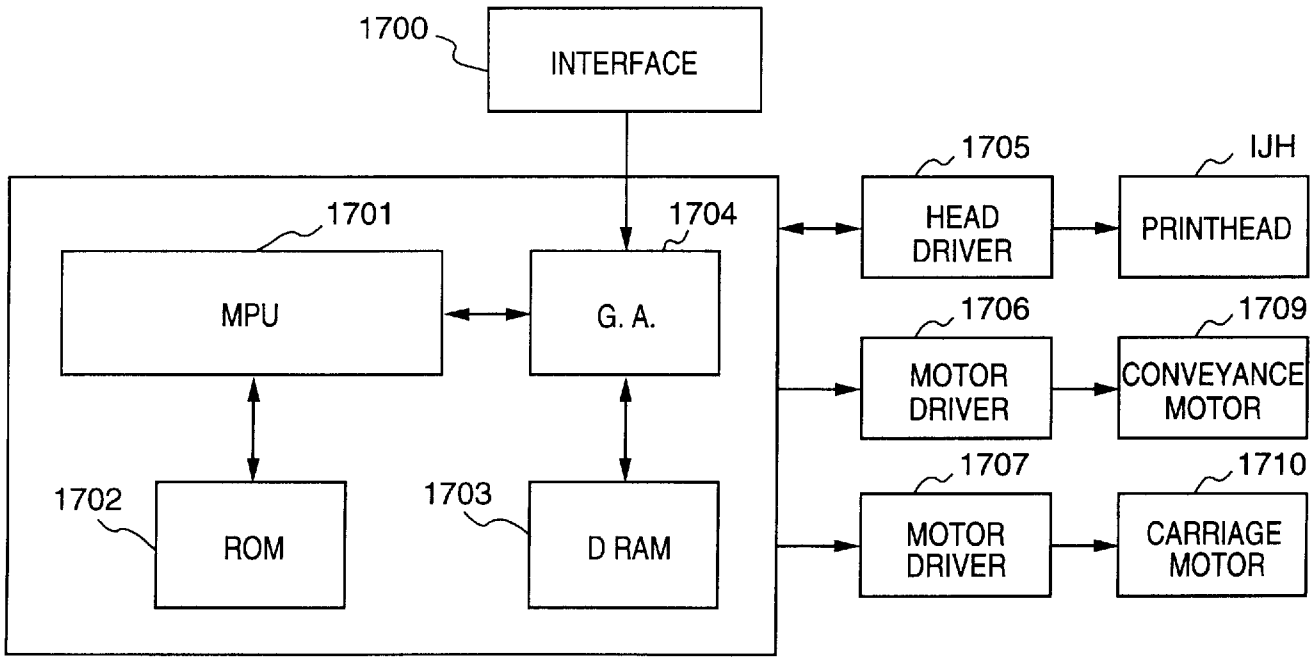
FIG. 2 is a block diagram illustrating a configuration of a control circuit of the ink-jet printer IJRA.

FIG. 2 is a block diagram showing the arrangement of a control circuit of the printer IJRA. Referring to FIG. 2, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703. Reference numeral 1710 denotes a carriage motor for conveying the printhead IJH; and 1709, a conveyance motor for conveying a printing paper sheet. Reference numeral 1705 denotes a head driver for driving a printhead IJH; and 1706 and 1707, motor drivers for driving the conveyance motor 1709 and the carriage motor 1710, respectively.

The operation of the above control arrangement will be described below. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the head driver 1705, thus performing the printing operation.

<Configuration of Circuit Substrate of a Printhead>

Figure 3A:
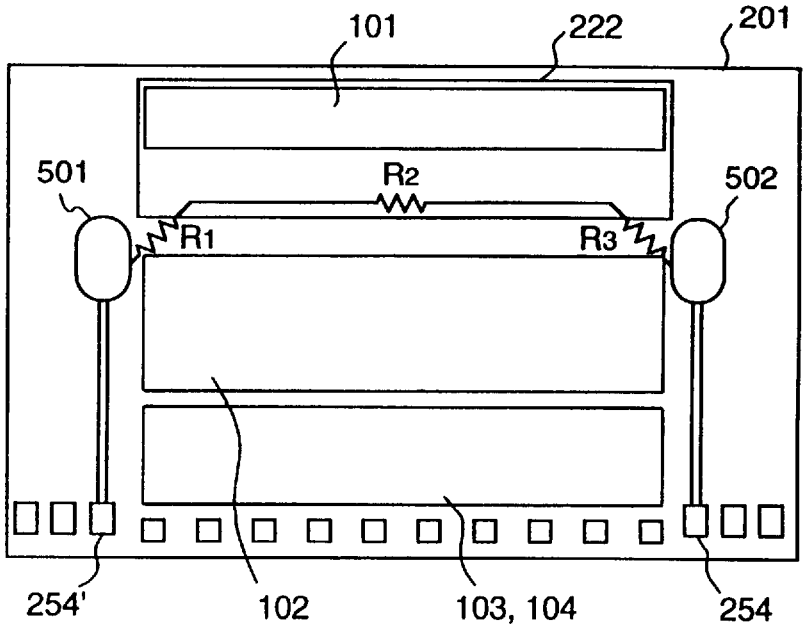
FIGS. 3A and 3B are block diagrams illustrating circuit substrates of a printhead IJH according to the embodiment.
Figure 3B:
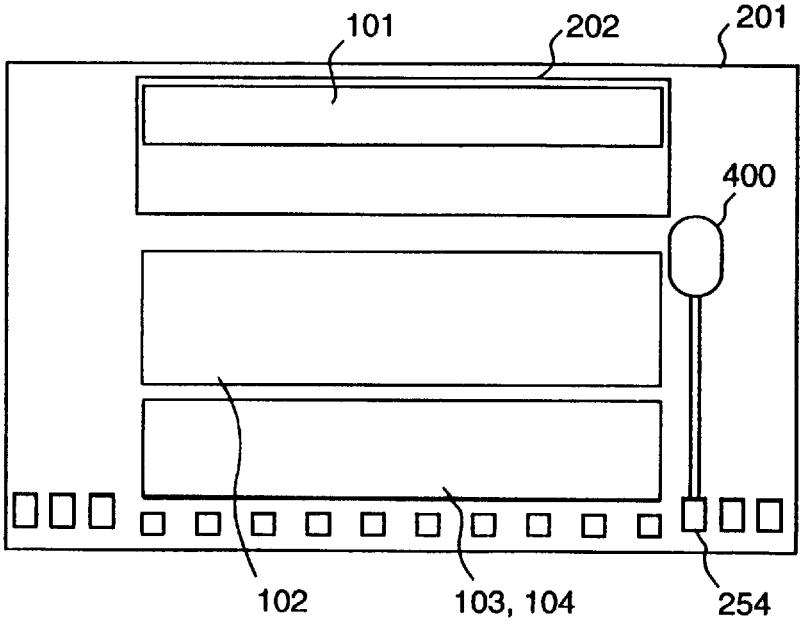
Figure 11:
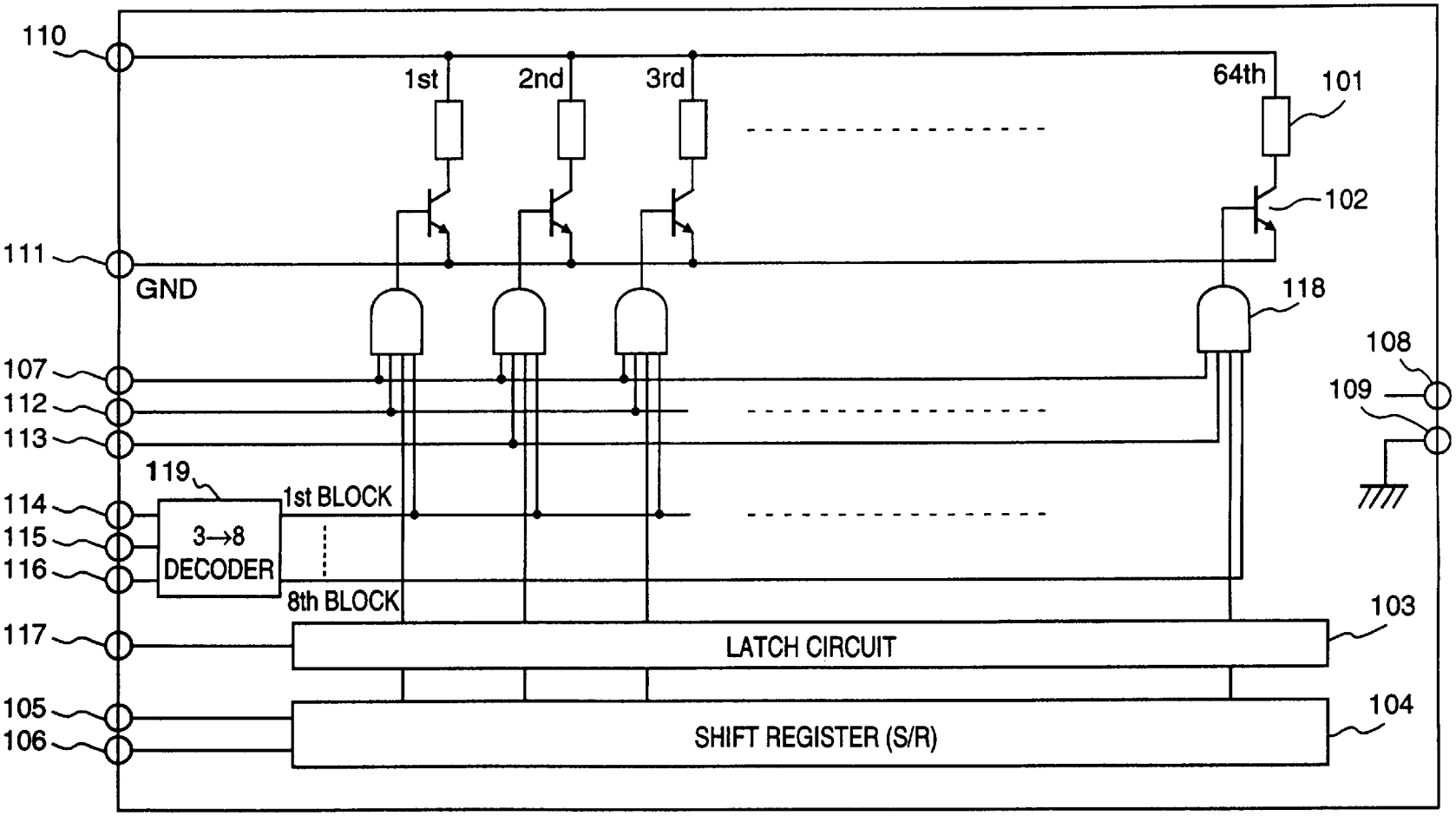
FIG. 11 PRIOR ART
FIG. 11 shows a logic circuit of the conventional printhead.
Figure 12:
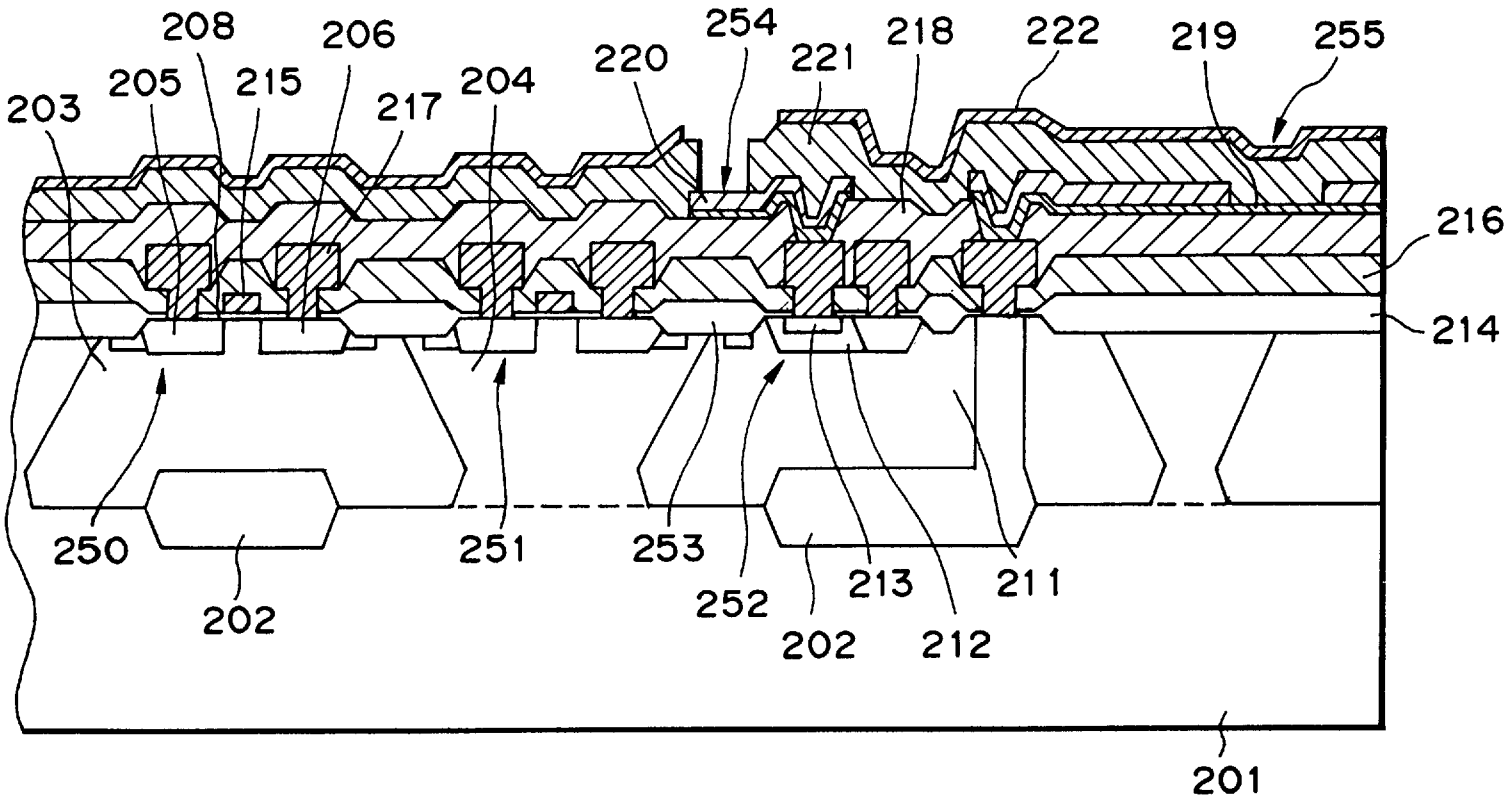
FIG. 12 PRIOR ART
FIG. 12 is a cross-sectional view of a conventional printhead board.
Figure 13:
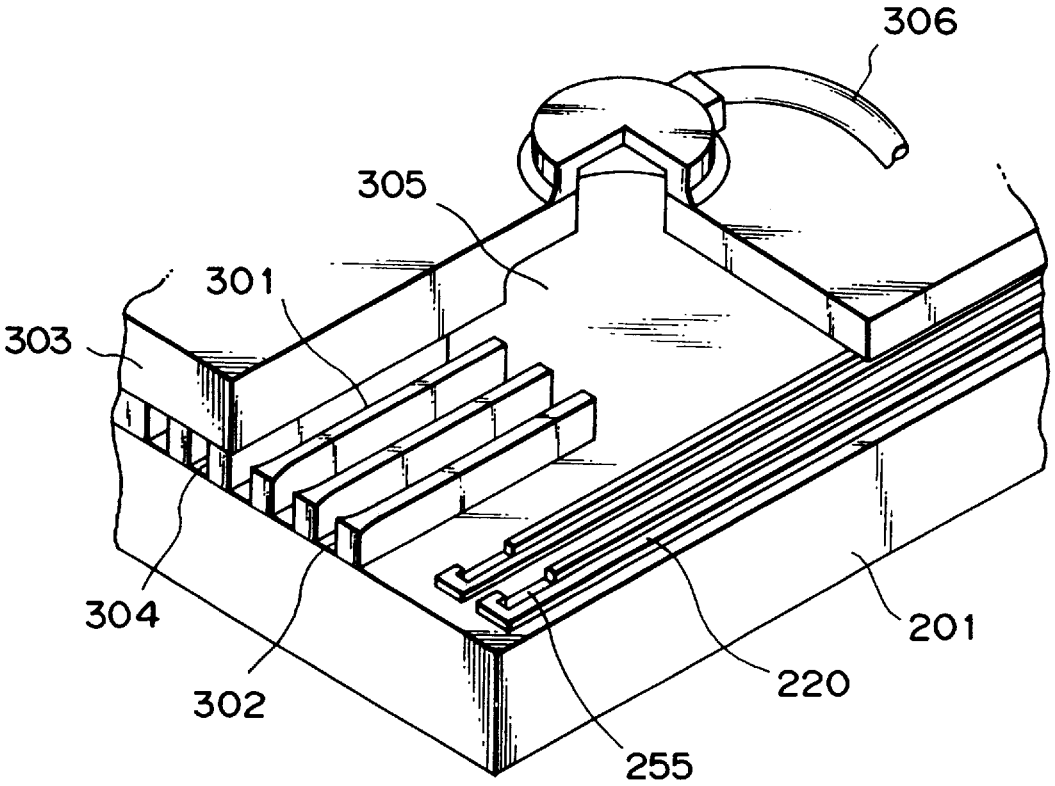
FIG. 13 PRIOR ART
FIG. 13 is an external perspective view shown by cutting a part of a conventional printhead adopting the ink-jet method.

FIGS. 3A and 3B are block diagrams illustrating circuit substrates of printheads IJH according to the embodiment. FIG. 3A is an example where ink sensors 501 and 502 are integrated on the circuit substrate, and FIG. 3B is an example where thermosensor unit 400 is integrated on the circuit substrate. In FIGS. 3A and 3B, the same units and elements as those of conventional printhead shown in FIGS. 11 and 12 are referred by the same reference numerals and explanations of those are omitted. Further, in FIGS. 3A and 3B, details of common configuring elements and elements which do not configure a feature of the present invention are omitted.

In FIG. 3A, the pad part 254 serves as output terminals of the ink sensors 501 and 502, whereas in FIG. 3B, the pad part 254 serves as an output terminal of the thermosensor unit 400.

The detailed configurations of the apparatuses when the ink sensors are integrated and the thermosensor is integrated as well as detection operation of ink discharge failure are explained below. The term, "ink discharge failure", indicates a state where ink is not discharged because of bubbles formed in the ink supply tube and in the common ink chamber as described above, for example.

[Apparatus Integrated with the Ink Sensors]

Here, a detection operation of the ink discharge failure using the ink sensors will be described.

Figure 4:
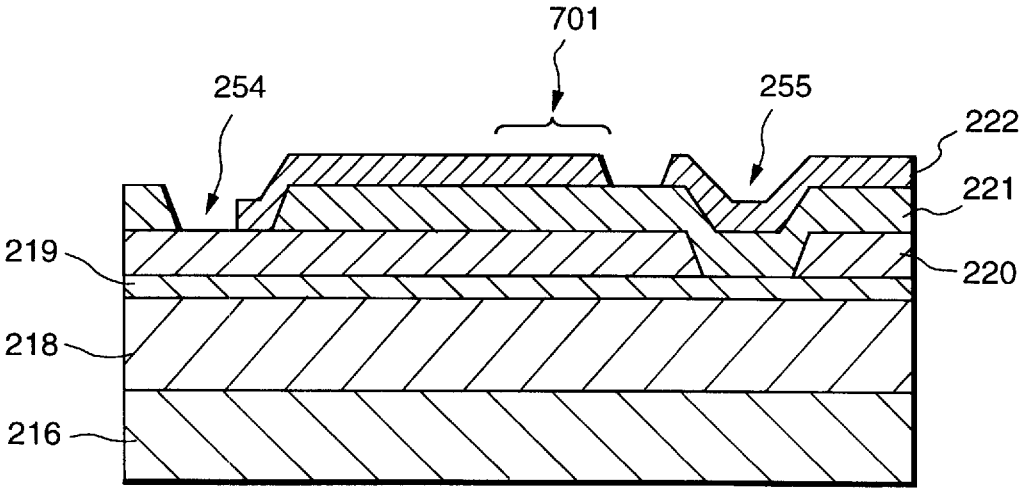
FIG. 4 is a cross-sectional view of a printhead board on which an ink sensor is formed by patterning a part of a tantalum film 222.

In this embodiment, a part of tantalum film 222 serving as the anti-cavitation film for the heating element is patterned so as to act as an ink sensor (701 in FIG. 4). In FIG. 3A, two sensors, namely the ink sensors 501 and 502, are integrated on the printhead board.

Figure 5:
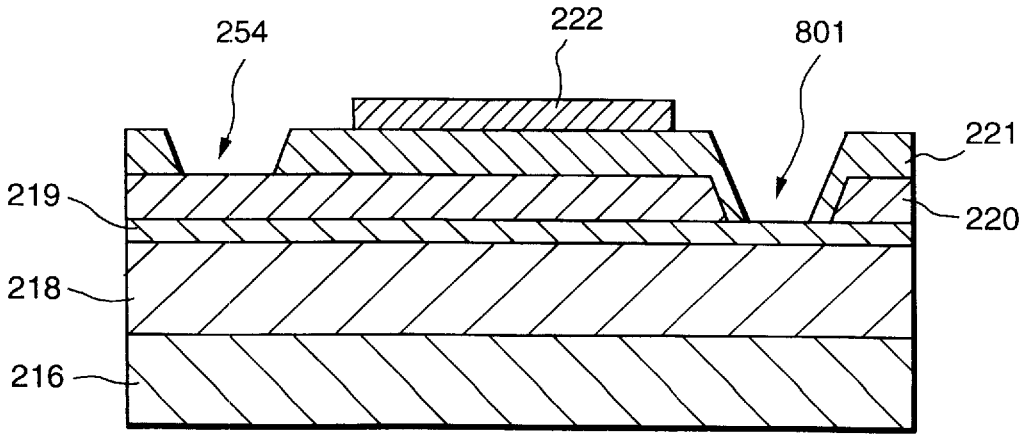
FIG. 5 is a cross sectional view of a printhead board on which a part of a resistance layer 219 is formed into an ink sensor.

FIG. 4 is a cross-sectional view of the printhead board on which an ink sensor is integrated by patterning a part of the tantalum film 222. Referring to FIG. 4, after forming the passivation film 221, the pad part 254 is opened, then the tantalum film is formed and patterned, thereby forming the sensor 701. Further, as shown in FIG. 5, the ink sensors on the printhead board can be formed by a resistance layer 219 which serves as the heater layer. In this case, after the passivation film 221 is formed, the pad part 254 and an ink sensor part 801 are opened, thereafter, the tantalum film 222 is formed, finally, patterned as an anti-cavitation interlayer insulation film 216 and the elements other than the sensors are not shown in FIGS. 4 and 5.

The total resistance between the sensors 501 and 502 are the sum of resistance of ink (R1) between the sensor 501 and the tantalum film, resistance of tantalum film (R2), and resistance of ink (R3) between the tantalum film and the sensor 502. Here, in a case where the ink is in the nozzle of the printhead, the relationship among the resistance is R1, R3>>R2 and the total resistance is some kilo-ohm, although it somewhat differs depending on ingredients of ink. In contrast, in a case where ink does not exist in the printhead because it is filled with bubbles, for example, (namely in a case where the ink discharge failure occurs) R1 and R2 are so large that they can be considered as insulation resistance. Accordingly, by implementing an analog circuit which outputs signals of two levels in response to the above two resistance values, namely the resistance of some kilo-ohm and the insulation resistance, the existence or absence of ink can be known from the high or low level of an signal outputted from the analog circuit.

Therefore, by inputting the output signal to the printing apparatus and detecting the output signal level in it, it is possible for the printing apparatus to perform control on continuing a printing operation or in it, it is possible for the printing apparatus to perform control on continuing a printing operation or stopping the printing operation in order to perform an automatic recovery operation in response to the detected result.

Figure 6:
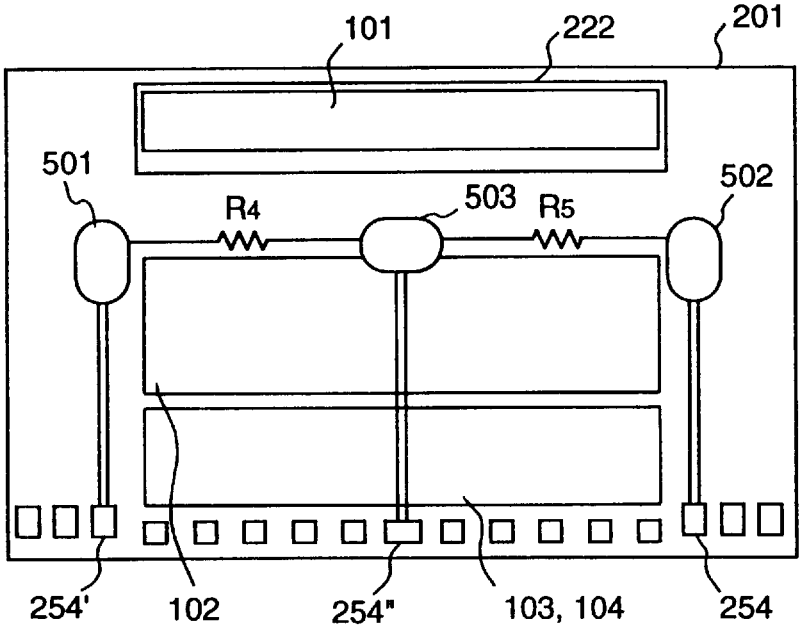
FIG. 6 shows a configuration of a printhead when three ink sensors are integrated.

Note that the configuration shown in FIG. 3A illustrates a configuration having the ink sensors in the both sides of the heater 101 and the power transistor 102. However, since the common ink chamber 305 is somewhat large, more than two ink sensors may be used in order to accurately detect the existence or absence of ink, or a state of bubbles. For example, the ink sensors 501 and 502 are arranged on the both sides of the heater 101 and the power transistor 102, and one more ink sensor 503 may be arranged at the center of the two sensors 501 and 502, as shown in FIG. 6. In this case, resistance R4 and R5 between the central ink sensor 503 and the respective ink sensors 501 and 502 arranged in the both sides are compared, thus it is possible to discriminate that there is no ink or there are bubbles in the common ink chamber 305 in a case where there is a big difference between the obtained resistance, and the printing operation is stopped and an automatic recovery operation is started.

Note, in FIG. 6, a pad part 254" denotes another output terminal for outputting a signal indicating the existence or absence of ink to the printing apparatus.

[Apparatus Integrated with the Thermosensor]

The ink discharge failure detection performed by using a diode as a thermosensor will be described below.

Figure 7:
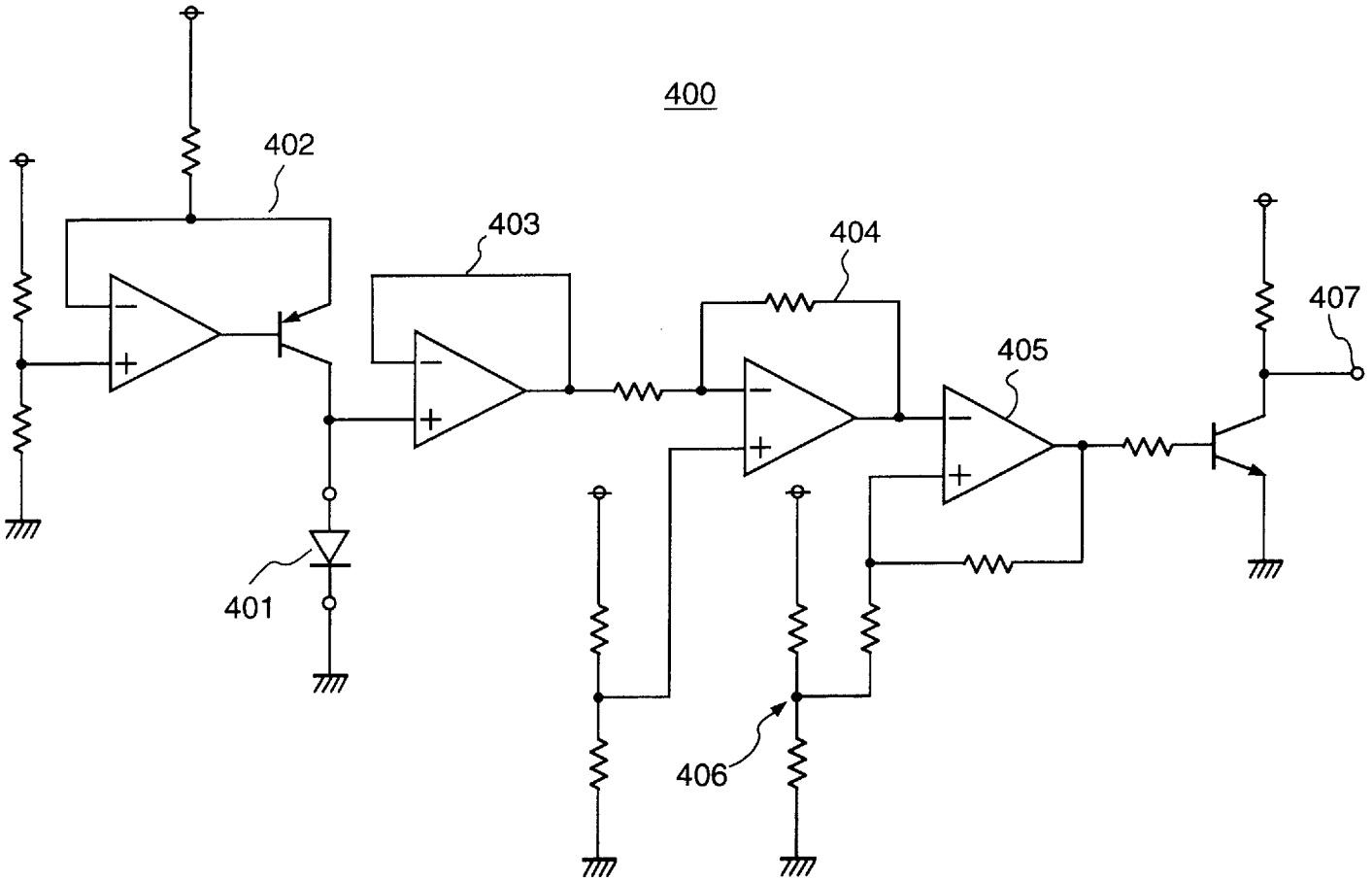
FIG. 7 is a circuit diagram showing a detailed configuration of a thermosensor integrated in a printhead and a thermosensor unit 400 including a driving circuit of the thermosensor.

FIG. 7 is a circuit diagram showing a detailed configuration of a thermosensor integrated in a printhead and a thermosensor unit 400 including a driving circuit of the thermosensor. This circuit is an example using a diode as the thermosensor.

Referring to FIG. 7, reference numeral 401 denotes a diode used as a thermosensor; 402, a constant current circuit for converting an output signal from the thermosensor 401 to a DC voltage; 403, a buffer; 404, an amplifier; 405, a comparator for comparing a threshold voltage 406 corresponding to a set temperature (Tth) and the DC voltage, converted by the constant current circuit 402, of an output from the thermosensor 401 corresponding to the temperature (T) of the printhead; and 407, an output terminal (corresponding to the pad part 254) to the printer IJRA. According to the circuit configuration shown in FIG. 7, a signal which changes its amplitude when T>Tth is outputted from the output terminal 407. Therefore, when a temperature of the printhead goes up abnormally because of the ink discharge failure, a signal is outputted to the printer IJRA.

Figure 8:
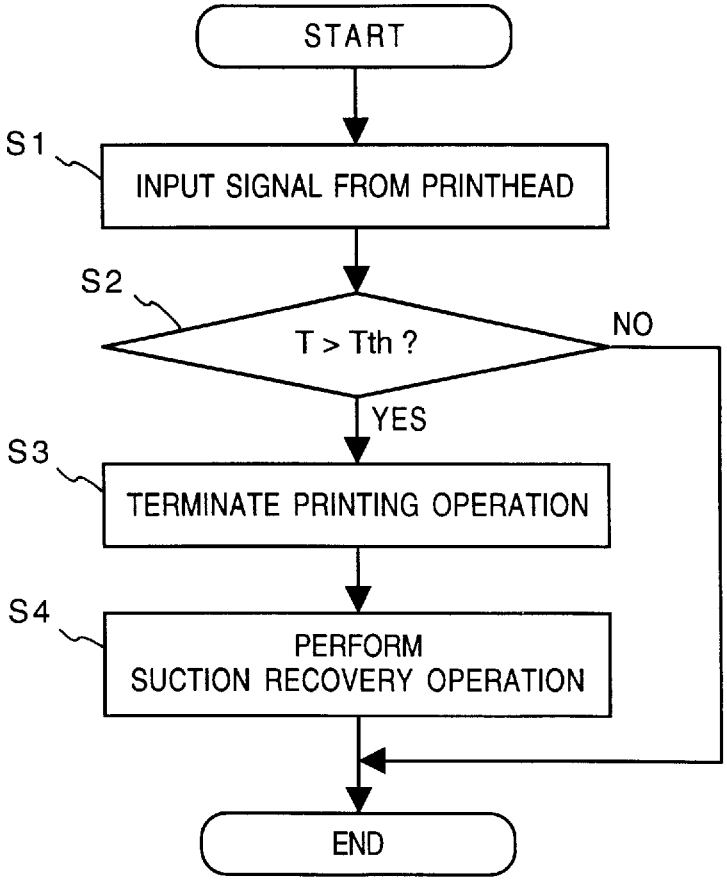
FIG. 8 is a flowchart showing a printing operation sequence performed by a control circuit of the ink-jet printer IJRA.

Whereas, the control circuit of the printer IJRA receives the signal from the output terminal 407 as in a flowchart in FIG. 8, and controls a printing operation.

More specifically, at step S1 (FIG. 8), the signal is inputted from the output terminal 407, then at step S2, whether the internal temperature (T) of the printhead is over the threshold temperature (Tth) or not is determined based on the inputted signal level. If T≦Tth, the processing is completed, whereas, if T>Tth, then the processing proceeds to step S3 where the printing operation is stopped, and a suction recovery operation is performed at step S4. Note that the processing at step S2 does not require calculation or comparison of the temperature, and whether the input signal level is high or low is only to be determined.

Further, in step S3, the suction recovery is performed as the recovery operation of the printhead IJH, however, in a case where the printer IJRA has a function of applying pressure to the ink flow channel inside of the printhead IJH to force to discharge ink from orifices of the printhead, a pressurization recovery operation can be used.

As described above, since the thermosensors and the processing circuit are provided in the printhead, the signals from sensors are analog-processed in the printhead. Accordingly, it is unnecessary for the printer to perform operation processes by executing a program, and the printer can stop the printing operation to start performing a recovery operation by sucking ink from nozzles at real time by performing a simple operation without putting more load on the MPU of the control circuit of the printer.

Note, the thermosensor and its processing circuit shown in FIG. 7 can be manufactured in the process of producing the Bi-CMOS like the heater driver or the logic circuit in the printhead board, thus the thermosensor and the processing circuit can be integrated in the printhead board. Further, the circuits realizing aforesaid functions can be integrated in an unused space in a conventional printhead board, thus manufacturing cost does not increase.

Figure 9:
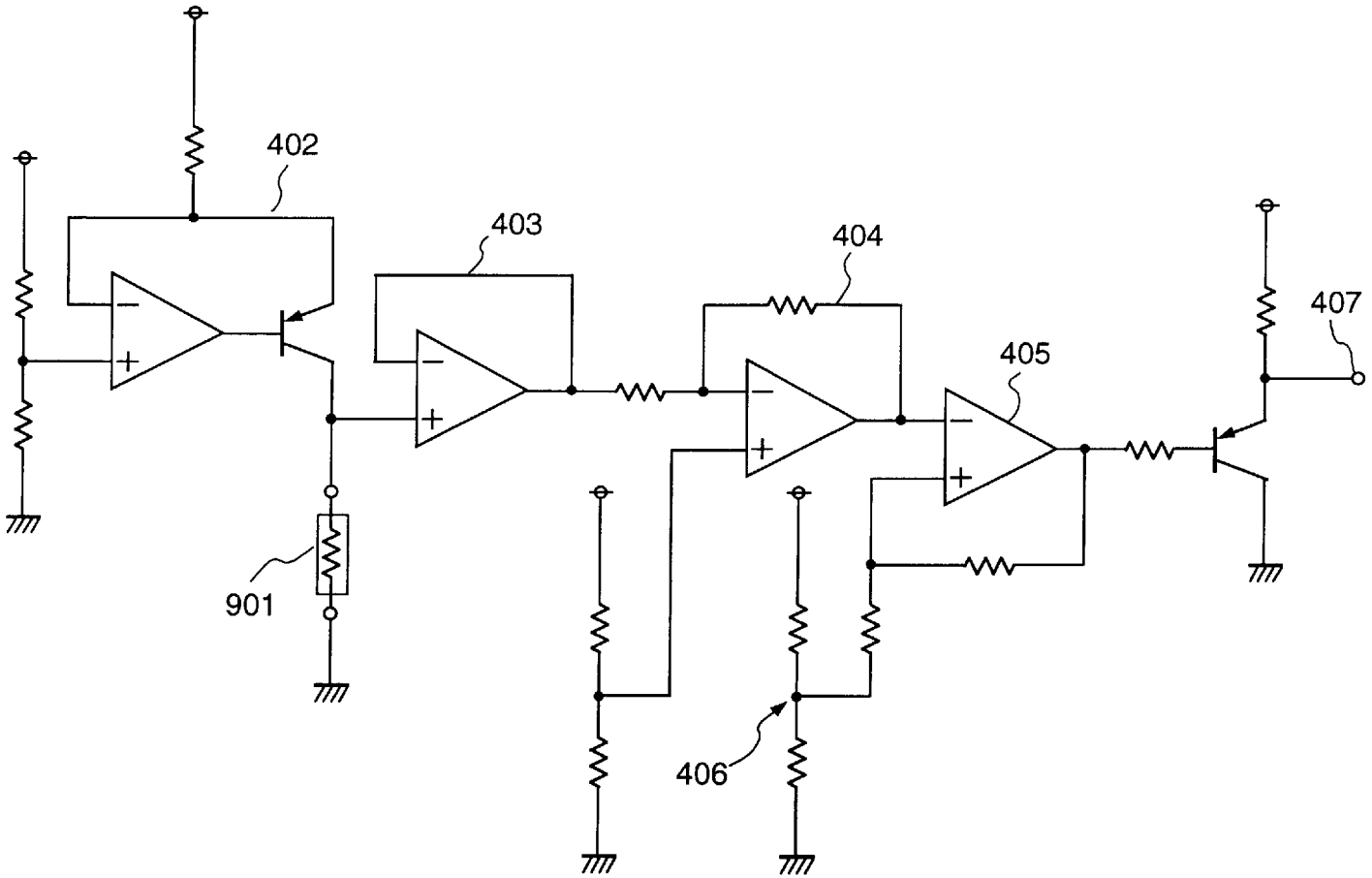
FIG. 9 is a circuit diagram showing a detailed configuration of a thermosensor integrated in a printhead and a thermosensor unit 400 including a driving circuit of the thermosensor according to another embodiment.
Figure 10A:
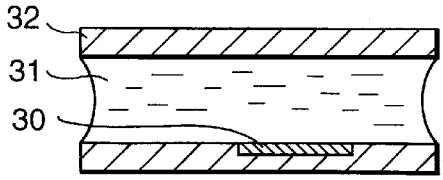
FIGS. 10A to 10G are explanatory diagrams showing a sequence of discharging an ink droplet.
Figure 10B:
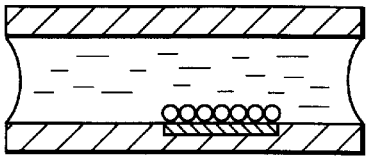
Figure 10C:
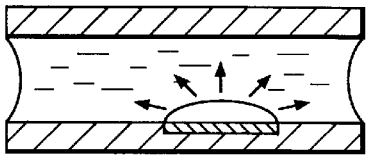
Figure 10D:
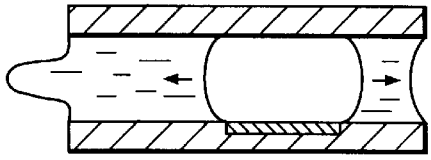
Figure 10E:
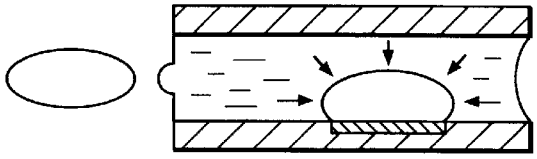
Figure 10F:
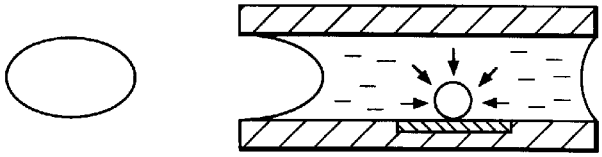
Figure 10G:
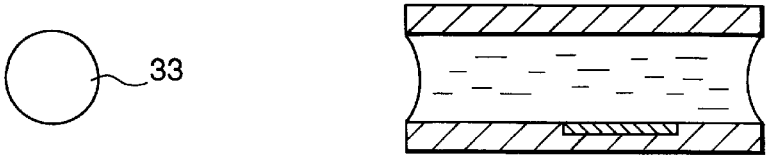

In the aforesaid embodiment, the thermosensor is explained by using a diode, however, materials, such as metal aluminum and polysilicon, used in the Bi-CMOS manufacturing process and film forming process of a heating element can be used because the changes of their resistance with respect to temperature are noticeably large, thus the same function as a diode can be realized. As shown in FIG. 9, for example, metal aluminum or polysilicon can be used as ink sensor resistance to configure the circuit instead of using the diode 401.

According to the embodiment as described above, ink sensors or a thermosensor is integrated in the printhead, and signals obtained from the sensors are inputted to a control circuit of a printer for controlling a printing operation, however, for more precise printing operation control, both of the ink sensors and the thermosensor can be integrated in the printhead, and signals from these sensors can be used for controlling printing operation.

Therefore, according to the embodiment, processed output signals from the ink sensors, or the thermosensor, or the ink sensors and thermosensor are inputted into the control circuit of the printer, then, when the control circuit detects existence of bubbles or an abnormal rise in temperature inside of the printhead on the basis of the input signals, the printing operation is stopped so as to perform the suction recovery. Thereby it becomes possible to prevent a print error caused by the ink discharge failure.

Further, since the output signals from the sensors or sensor are processed inside of the printhead and outputted to the printer, the control circuit of the printer does not have to perform complicated processing, thus no load is added to the MPU. Thereby, printing control can be performed at high speed in a simple processing. Therefore, printing control becomes possible without using a high performance MPU, thus manufacturing cost does not increase. Further, a sensor packaged on the printhead and its processing circuit do not require large space on the printhead, thus manufacturing cost does not increase by forming them in a semi-conductor manufacturing process.

Further, as a result of the aforesaid printing operation, the periodical automatic recovery operation becomes unnecessary, thus the amount of wasted ink consumed in a suction recovery is dramatically reduced, thus reducing running cost for a printing operation. For example, in a conventional ink cartridge integrated with a printhead, in a case where five printing paper sheets are printed per day, and the suction recovery is periodically performed once in a few days, the ink cartridge lasts about 450 printing paper sheets in about 90 days. In contrast, according to the aforesaid control of the present invention, the ink cartridge lasts about 500 printing paper sheets in about 100 days, thereby running cost is reduced.

Further, an amount of wasted ink sucked in the recovery operation is reduced, thus the size of an ink tank for storing the sucked ink in the printer can be reduced, thereby down-sizing of the printing apparatus is possible.

Further, a printing paper sheet is used as recording medium in the embodiment, however, the present invention is not limited to this. For example, recording medium includes ink absorbing materials, such as cloth, thread, sheet material, and so on, which can be colored with various inks.

The present invention produces excellent results when it is applied to a printhead which comprises means (e.g., an electrothermal transducer, laser beam generator, and the like) for generating heat energy as energy utilized upon execution of ink discharge, and causes a change in state of an ink by the heat energy, and a printer using the printhead among the ink-jet printers. According to the printing method, the ink discharge failure can be prevented effectively in terms of printer's running cost and print throughput.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid flow channels, and electrothermal transducers (linear liquid flow channels or right angle liquid flow channels) as disclosed in the above specifications, the arrangement using U.S. Pat. Nos. 4,558,333 and 4,459,600, which disclose the arrangement having a heat acting portion arranged in a flexed region is also included in the present invention. In addition, an arrangement of the printhead may be based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion. This is because the present invention is applicable to a printhead of any shape.

Furthermore, the present invention is also applicable to a full line type printhead having a length corresponding to the width of a maximum printing medium which can be printed by the printer. As such the printhead, either the arrangement which satisfies the full-line length by combining a plurality of printheads as disclosed in the above specification or the arrangement as a single printhead obtained by forming printheads integrally can be used.

In addition, the present invention is applicable to not only the aforesaid serial type printhead but also to an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself.

Furthermore, as for the type or the number of printheads or printhead to be installed in a printer, a single printhead corresponding to mono-color ink or a plurality of printheads respectively corresponding to ink of a plurality of colors and densities can be installed in a printer, for example. In other words, the present invention is especially advantageous when it is applied to a printer having at least one of following printing modes, namely a printing mode using only a primary color such as black or the like, a multi-color mode using a plurality of different colors and a full-color mode achieved by color mixing, where the latter two modes use either an integrated printhead or a combination of a plurality of printheads.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printhead for printing on a recording medium by applying an electric current pulse to an electrothermal transducer so as to generate heat, and discharging an ink droplet from a nozzle by utilizing the generated heat, said printhead comprising:

a driving circuit driving the electrothermal transducer;

a sensor circuit sensing a status of said printhead, and outputting a signal according to the sensed status;

a processing circuit determining existence or absence of ink in the nozzle, based on the signal outputted from said sensor circuit; and an output terminal outputting a result obtained by said processing circuit to outside as a determination result, wherein said sensor circuit, said processing circuit, and said output terminal are packaged together with said driving circuit in a substrate provided in said printhead.

2. The printhead according to claim 1, wherein said sensor circuit includes a thermosensor for measuring temperature inside of said printhead, and the signal outputted from said sensor circuit depends on the temperature.

3. The printhead according to claim 2, wherein said processing circuit comprises a comparator for comparing an output signal from said thermosensor and a predetermined output signal corresponding to threshold temperature set in said processing circuit, and said comparator outputs a signal whose output level differs in dependence upon a comparison result from said output terminal.

4. The printhead according to claim 2, wherein said thermosensor is made of a diode, aluminum, polysilicon, or the like, which changes resistance in a large rate in response to temperature.

5. The printhead according to claim 4, wherein said thermosensor is formed in a semi-conductor manufacturing process along with said processing circuit and said driving circuit.

6. The printhead according to claim 1, wherein said sensor circuit includes a sensor for measuring electrical resistance inside of the nozzle, and the signal outputted from said sensor circuit depends on the electrical resistance.

7. The printhead according to claim 6, wherein said output terminal outputs a signal of an output level which differs in accordance with a measured result of the electrical resistance.

8. The printhead according to claim 7, wherein a number of output levels of the output signal from said output terminal is two, and the output levels are a high level and a low level.

9. The printhead according to claim 6, wherein an upper surface of the substrate is covered with a passivation film, and the sensor for measuring electrical resistance is formed in a part of the passivation film.

10. The printhead according to claim 9, wherein the part of the passivation film where the sensor is formed is a tantalum film.

11. The printhead according to claim 10, wherein the sensor for measuring electrical resistance is formed by patterning the tantalum film in a semi-conductor manufacturing process.

12. The printhead according to claim 9, wherein a plurality of the sensors for measuring electrical resistance are formed.

13. The printhead according to claim 1, wherein said sensor circuit comprises a thermosensor for measuring temperature inside of said printhead and a circuit for measuring electrical resistance inside of the nozzle.

14. The printhead according to claim 13, wherein said processing circuit comprises a comparator for comparing an output signal from the thermosensor and a predetermined output signal corresponding to threshold temperature set in said processing circuit, and the comparator outputs a signal whose output level differs in dependence upon a comparison result from said output terminal.

15. A printing apparatus using the printhead claimed in claim 1, comprising:

input means for inputting the determination result outputted from said output terminal;

recovery means for performing a recovery operation by discharging ink from said printhead; and recovery operation control means for terminating a printing operation in accordance with the determination result and controlling said recovery means so as to perform the recovery operation.

16. The apparatus according to claim 15, wherein said recovery means includes suction recovery means for performing the recovery operation by sucking ink from an orifice of said printhead.

17. The apparatus according to claim 15, wherein said recovery means includes pressurization recovery means for performing the recovery operation by applying pressure to an ink flow channel inside of said printhead so as to forcedly to discharge ink.

18. The apparatus according to claim 15, further comprising print control means for controlling said printhead to perform printing.

19. The apparatus according to claim 18, wherein said recovery operation control means comprise comparing means for comparing the determination result and a predetermined threshold, and designates to said print control means to stop a printing operation in accordance with a comparison result by said comparison means as well as designates said recovery means to start operating.

20. A printing apparatus for printing an image on a printing medium by using a printhead which discharges ink from a nozzle, comprising:

input means for inputting a signal indicating a result of determining existence or absence of the ink in the printhead;

recovery means for performing a recovery operation by discharging the ink from the printhead; and recovery operation control means for terminating a printing operation in accordance with the signal inputted by said input means and controlling said recovery means so as to perform the recovery operation.

21. The apparatus according to claim 20, wherein said recovery means includes suction recovery means for performing the recovery operation by suctioning the ink from an orifice of the printhead.

22. The apparatus according to claim 20, wherein said recovery means includes pressurization recovery means for performing the recovery operation by applying pressure to an ink flow channel inside of said printhead so as to forcedly discharge the ink.

23. The apparatus according to claim 20, further comprising print control means for controlling the printhead to perform printing.

24. The apparatus according to claim 20, wherein the signal inputted by said input means is outputted from the printhead.

25. The apparatus according to claim 24, wherein the printhead includes a circuit sensing a status of the printhead and determining the existence or absence of the ink in the nozzle.

26. The apparatus according to claim 20, wherein the printhead includes an electrothermal transducer, and an electric current pulse is applied to the electrothermal transducer so as to generate heat and discharge the ink by utilizing the generated heat.

* * * * *

UNITED STATES PATENT AND TRADEMARK OFFICE

CERTIFICATE OF CORRECTION

PATENT NO. : 5,886,713

DATED : March 23, 1999

INVENTOR(S) : OKADA ET AL.

It is certified that error appears in the above-identified patent and that said Letters Patent is hereby corrected as shown below:

COLUMN 14:

Line 47, "to" should be deleted.

Signed and Sealed this

Nineteenth Day of October, 1999

*Attest:*

*Attesting Officer*

Q. TODD DICKINSON

*Acting Commissioner of Patents and Trademarks*